US005615527A

United States Patent [19]

Attley

[11] Patent Number: 5,615,527

[45] Date of Patent: Apr. 1, 1997

[54] FABRICATED ROOF TILE

[76] Inventor: Begonia Attley, The Green, Horton-cum-Studley, Oxfordshire, England, 0X9 1AY, United Kingdom

[21] Appl. No.: 325,328

[22] PCT Filed: Apr. 26, 1993

[86] PCT No.: PCT/GB93/00862

§ 371 Date: Jan. 3, 1995

§ 102(e) Date: Jan. 3, 1995

[87] PCT Pub. No.: WO93/22523

PCT Pub. Date: Nov. 11, 1993

[30] Foreign Application Priority Data

Apr. 30, 1992 [GB] United Kingdom ..... 9209397

[51] Int. Cl.[6] ..... E04D 1/18; E04D 3/30

[52] U.S. Cl. ..... 52/535; 52/518; 52/542; 52/555

[58] Field of Search ..... 52/311.1, 314, 52/518, 520, 521, 535, 536, 537, 538, 539, 542, 546, 554, 555, 556, 385, 390, 391

[56] References Cited

U.S. PATENT DOCUMENTS

| | | | |
|---|---|---|---|
| 146,140 | 1/1874 | Momenthy | 52/538 |
| 734,976 | 7/1903 | Simmerman | 52/518 X |
| 1,775,930 | 9/1930 | Bosquet | 52/542 X |
| 3,629,988 | 12/1971 | Zylstra | 52/542 X |
| 3,754,366 | 8/1973 | Jansson et al. | 52/555 X |
| 4,130,974 | 12/1978 | Chalmers et al. | 52/555 X |
| 4,729,202 | 3/1988 | Ferland | 52/536 X |
| 4,890,432 | 1/1990 | Shepherd | 52/542 X |
| 5,174,092 | 12/1992 | Naden | 52/542 X |

FOREIGN PATENT DOCUMENTS

| | | | |
|---|---|---|---|
| 456273 | 11/1991 | European Pat. Off. | 52/518 |
| 874256 | 8/1942 | France . | |
| 1513384 | 2/1968 | France . | |
| 2367167 | 5/1978 | France . | |
| 2491978 | 4/1982 | France . | |
| 46117 | of 1889 | Germany | 52/554 |
| 55504 | 4/1891 | Germany . | |
| 1509120 | 9/1969 | Germany | 52/555 |
| 3612023 | 10/1986 | Germany . | |
| 284651 | 11/1989 | Japan | 52/518 |
| 121752 | 2/1927 | Switzerland . | |
| 177885 | 6/1935 | Switzerland . | |

*Primary Examiner*—Carl D. Friedman
*Assistant Examiner*—Kevin D. Wilkens
*Attorney, Agent, or Firm*—Paul E. Milliken; Lee A. Germain

[57] ABSTRACT

A roof tile formed of a sheet metal, preferably steel, in which the sheet material tile is strengthened by integral flanges (11) raised bosses (14) and depressions (15). The raised bosses (14) in use act as supports between one tile and an overlapping portion of another tile.

10 Claims, 4 Drawing Sheets

FABRICATED ROOF TILE

This invention relates to roof tiles and in particular to roof tiles formed from thin sheet material.

A problem associated with ceramic and slate roof tiles is their inherent lack of flexural strength and brittleness, particularly in the case of roofing slate, so that rooves made from slates or tiles can be easily damaged by persons walking over the roof.

A further problem associated with large slates and roof tiles in that due to their weight should they come loose from the roof and fall to the ground, they are extremely dangerous and could cause injury or death if a falling tile should strike a person or animal.

In the past fabricated roof tiles have been formed from heavily filled plastic materials, such as P.V.C., coloured to appear like slates. However, these tiles are again brittle and will easily snap into pieces if subject to flexural loads for example by persons walking on them during maintenance. Flat thin sheet metal roof tiles could be used but such tiles whilst not being brittle will tend to bend and distort when walked upon.

The present invention provides a roof tile which overcomes the above problems.

Accordingly there is provided a sheet metal roof tile which in use co-operates with other such roof tiles for laying in rows upon a roof such that tiles in one row overlap the upper portions of tiles in a lower row, and are themselves overlapped by the pans of tiles in an upper row, characterised in that the sheet metal tile is formed with at least one offset strengthening portion raised out of the plane of the tile and which in use acts as support to a pan of an overlapping portion of another tile.

The invention also comprises a roof covering comprising a plurality of roof tiles of the above type arranged side-by-side in a single row , the tiles being formed as a single sheet metal pressing and being connected at their lateral edges.

The invention will be described by way of example and with reference to the accompanying drawing in which.

Figure 1:
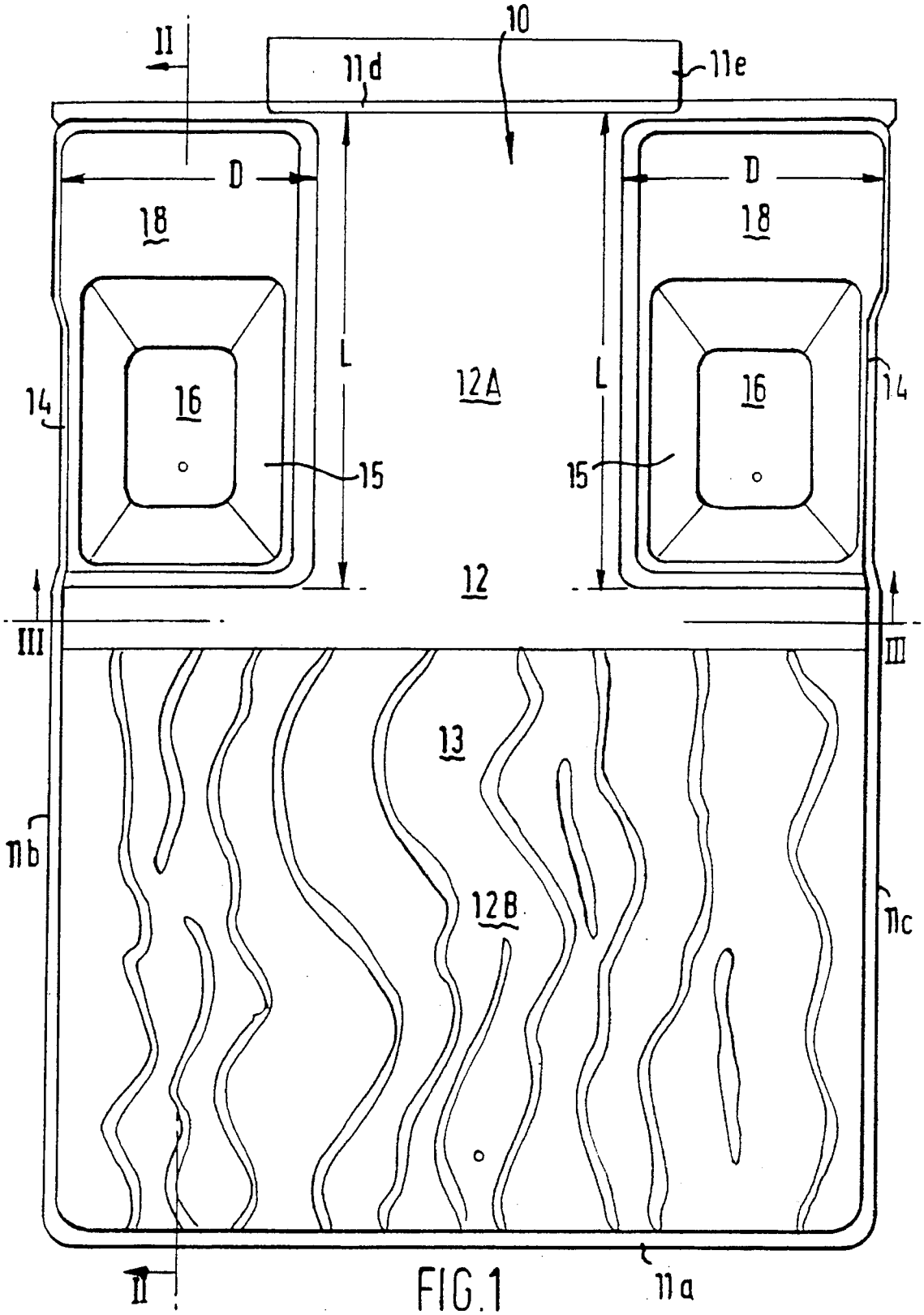
FIG. 1 is a plan view of a tile according to the invention.
Figure 2:
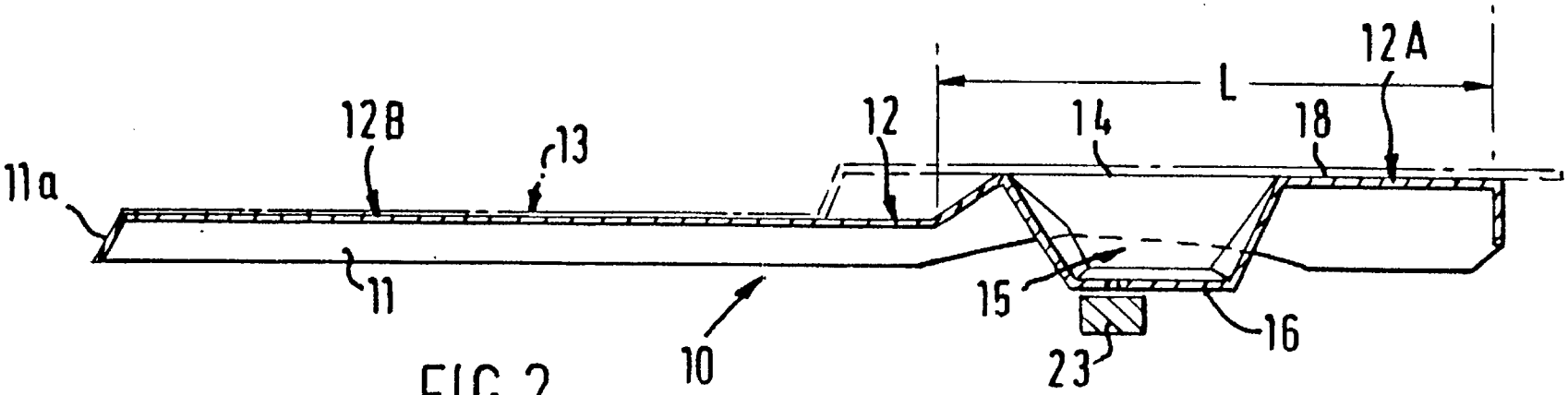
FIG. 2 is a section on the line II—II of FIG. 1.
Figure 3:
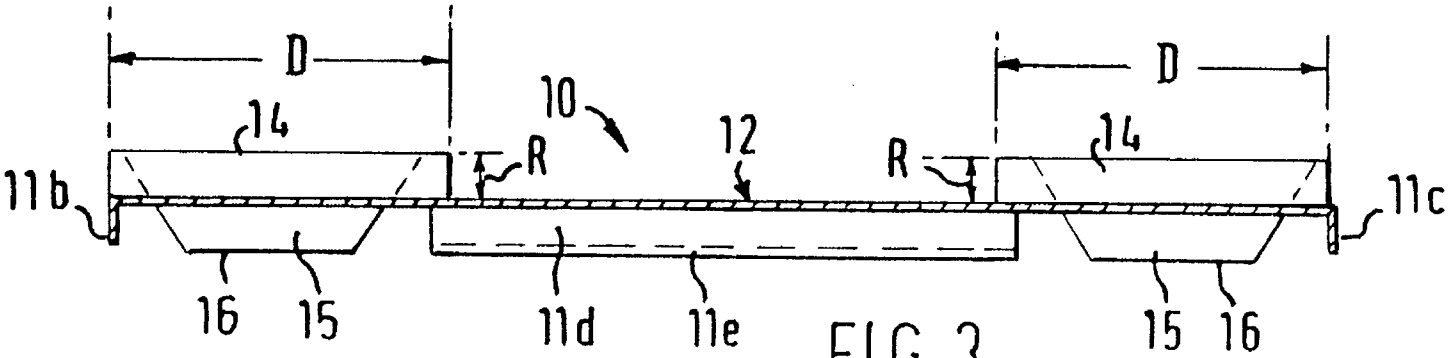
FIG. 3 is a section on the line III—III of FIG. 1.

With reference to FIGS. 1 to 3 there is illustrated a roof tile formed from a sheet metal pressing, preferably from sheet steel having a thickness of between 0.5–0.9 mm, or sheet aluminium.

The tile 10 shown is a rectangular tile having a length of 20 ⅞" and a width of 10 ⅝" (530 mm ×270 mm) however, other sizes and shapes could be selected.

The tile 10 has a substantially flat body portion 12 which has a turned down peripheral flange 11 around its outer edges.

The flange 11 comprises an inclined bottom flange 11*a* along the bottom edge of the tile 10 (that is the bottom edge in use when secured on a roof), substantially vertical side flanges 11*b*, 11*c*, and a top edge flange 11*d*. The peripheral flange 11 is about 6 mm in depth and serves two purposes, it strengthens the outer edge margins of the tile 10 and it also gives an appearance of "body" or thickness to the roof tile when viewed from the ground.

The tile 10 has an upper portion 12A which is reinforced by offset portions swaged out of the metal sheet, and a lower portion 12B of the tile which forms a substantially flat pan of the tile.

The upper surface 13 of the lower half of the tile is painted to look like slate, for example, with a layer of powder coated paint 13 which can be formed with an artificial grain effect to enhance its slate like appearance. Alternatively it can be coloured to look like other traditional roof covering materials such as concrete or clay tiles.

The upper portion 12A of the tile 10 has raised bosses 14 formed as a pair of spaced apart offset portions 14 raised above the general plane of upper surface of the pan 12B and the center portion of the upper portion 12A which together, define a primary plane of the tile. The two offset portions 14 each extend laterally inwardly from a respective side edge for a distance D which is about 30% of the width of the tile, and extend longitudinally downwards from the top edge 11D for a distance 'L' which is about 40% of the length of the tile 10. The offset portions 14 have a flat upper surface 18 and are raised above the body 12 or primary plane of the tile by a distance R of about 7 mm so that the height of the offset (7 mm) is slightly greater than the overall thickness (6 mm) of the pan 12B of the tile 10 which is set by the depth of the peripheral flange.

Each raised offset portion 14 is formed with a depression 15 having a flat base 16 which is offset below the primary plane of the body of the tile so that the bases 16 are approximately in alignment with the ends of the turned over bottom edge flange 11*a*, and the lower portions of the side flanges 11*b* and 11*c*. The dimension of the depressions 15 and their bases 16 are sufficient to allow access by a hammer head. The offset portions 14 and depressions 15 also help strengthen the tile together with the flanges 11.

The top edge flange 11*d* extends away from the body portion 12A of the tile between the two offset portions and is formed with a horizontal edge portion 11*e* providing a back rest in use against one of a plurality of spaced apart roof battens 23 to which the tiles are fixed and one of which is shown in FIG. 2.

Figure 4:
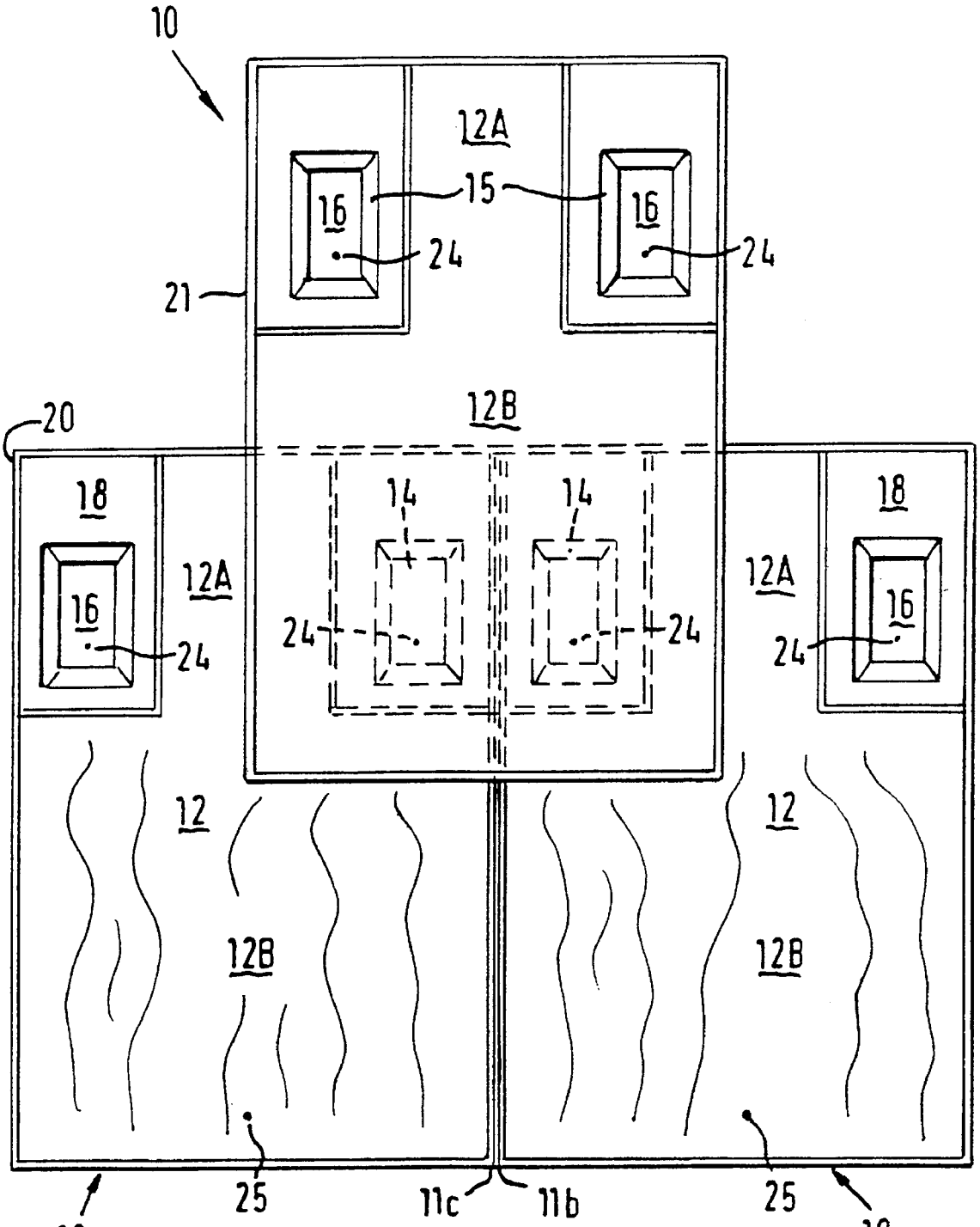
FIG. 4 is a sketch showing the overlapping arrangement between two rows of tile.

With reference now, also to FIG. 4, the tiles 10 are laid on a roof in rows 20, 21, secured to roof battens 23 or other wooden supports so that lower portion or pan 12B of each tile in the upper row 21 overlaps with the upper portions 12A of the tiles in the lower row 20. As can be seen, the tiles are fixed in position to a roof batten 23 (see FIG. 2) by nails passing through holes 24 in the base 16 of each depression 15, with the undersides of the bases 16 resting against a batten. The flange 11*d* and horizontal edge portion 11*e* of one course of tiles contacts the batten 23 of the adjacent upper course of tiles (without interfering with the connection between that batten and the adjacent tile's depression 15). When tiles 10 are laid in the conventional manner the substantially flat pans 12B of each tile in the upper row 21 extend over and rest on a raised offset portion 14 on each of a pair of adjacent tiles in the lower row 20 with the turned over side edge flanges 11*b*, 11*c* being accommodated by the flat portion of the tile between the offset portions 14.

The upper flat surface 18 of each offset portions 14 on the lower row tiles 20 provides support for the underside of the pan of one of the tiles in the upper row 21 of tiles, so that each tile 10 in use supports the tile above. Further the formed offsets 14, depressions 15 and flanges 11 provide a reinforced structure formed out of the steel sheet in a single stamping operation.

In use it may be necessary to provide a hole 25 at a central location in the lower half of each tile to provide a means for holding each lower half down against a batten using copper disc nails to prevent lifting by high winds.

A roof formed from the above tiles is a very strong, tough, light weight, structure, that can be walked on without danger of breaking or bending the tile, has an appearance that is that of slate, and cannot be dangerous to persons or animals below.

Figure 5:
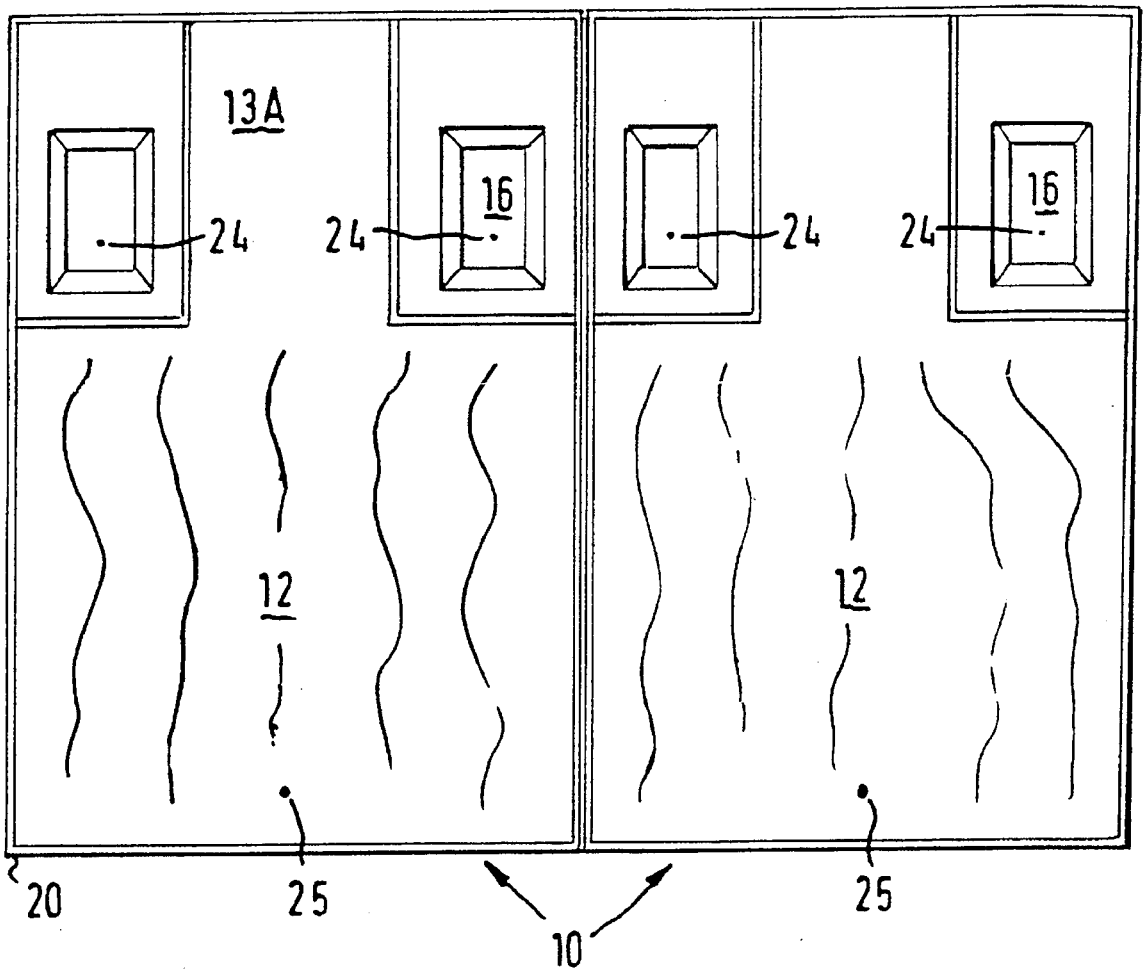
FIG. 5 is a roof covering comprising two side-by-side tiles in a single sheet metal pressing.

FIG. 5 illustrates a roof covering 10 formed from two tiles 10 formed integrally from a single metal sheet. The tiles as illustrated are formed as pairs 600 mm×300 mm tiles to give a roof covering of approximately 600×600 mm. The covering has identical features to the tile described above.

The covering comprises a single row of side-by-side roof tiles connected through their lateral edges. Any number of tiles can be formed in a single row dependant upon the size of the tile. For large tiles e.g. 600 mm×300 mm the number is unlikely to exceed two, but for smaller tiles e.g. 500 mm×250 mm there could be upto four tiles per row, and for 300 mm×150 mm there could be upto six tiles per row.

However in each roof covering the raised portions in the upper portions of each tile will support a pan of an overlapping above tile.

I claim:

1. A sheet metal roof tile having an upper portion and a substantially flat lower portion and which in use, co-operates with other such roof tiles for laying in rows upon a roof such that the substantially flat lower portions of the tiles in one row substantially overlap the upper portions of tiles in a lower row, and are off-set relative thereto, and the upper portions of said tiles are themselves substantially overlapped by the substantially flat lower portions of tiles in an upper row, the tile having an upper surface with a major area portion of the surface defining a substantially flat primary plane of the tile, the sheet metal tile being formed with at least one off-set strengthening portion raised above the primary plane of the tile, characterised in that each off-set portion is formed in the upper portion of the tile and has an upper surface raised above the primary plane of the tile to a height greater than the overall thickness of the lower portion of the tile, and positioned on the upper portion of the tile such that said upper surface of each offset portion in use, supports the underside of the substantially flat lower portion of an overlapping portion of another tile.

2. A roof tile as claimed in claim 1, characterised in that the upper portion of the roof tile has two offset strengthening portions symmetrically spaced laterally apart.

3. A roof tile as claimed in claim 2, characterised in that the tile has a turned down flange around its outer peripheral edge.

4. A roof tile as claimed in claim 3 characterised in that the offset portions extend laterally inwardly from the side edges of the tile for about 30% of the width of the tile, and from the top edge downwardly for about 40% of the length of the tile.

5. A roof tile as claimed in claim 3, characterised in that the offset strengthening portion is raised above the primary plane of the tile by a height which is only slightly greater than the depth of the edge flanges around the lower portion of the tile.

6. A roof tile as claimed in claim 1 characterised in that a depression is located within each raised off-set portion such that the base of each depression in use abuts a support for securing the tile thereto.

7. A roof tile as claimed in claim 1, characterised in that the upper edge of the tile has a flange in the plane of the tile such that in use the flange rests against a support.

8. A roof tile as claimed in claim 1 characterised in that the upper surface of the lower portion of the tile is decorated with a surface effect to resemble slate, concrete or clay.

9. A roof covering comprising a plurality of roof tiles as claimed in claim 1, arranged side-by-side in a single row, the tiles being formed from a single sheet metal pressing and being joined at their side edges.

10. A method of forming a roof from a plurality of sheet metal roof tiles each having an upper portion and a substantially flat lower portion and which in use, co-operates with other such roof tiles for laying in rows upon a roof such that the substantially flat lower portions of the tiles in one row substantially overlap the upper portions of tiles in a lower row, and are offset relative thereto and the upper portions of said tiles are themselves substantially overlapped by the substantially flat lower portions of tiles in an upper row, each tile having an upper surface with a major area portion of the surface defining a primary substantially flat plane of the tile, the sheet metal tile being formed with at least one off-set strengthening portion raised above the primary plane of the tile, characterised in that each off-set portion is formed in the upper portion of the tile and has an upper surface raised above the primary plane of the tile to a height greater than the overall thickness of the lower portion of the tile, and positioned on the upper portion of the tile such that said upper surface of each offset portion in use, supports the underside of the substantially flat lower portion of an overlapping portion of another tile and in which a depression is located within each raised off-set portion such that a base of each depression in use, abuts a support for securing the tile thereto, wherein said method comprises fixing the tiles to a support so that the underside of the base of the depression rests against the support and the upper surface of the raised off-set portion supports the substantially flat lower portions of overlapping tiles.

* * * * *